United States Patent [19]

Kallman

[11] 4,418,733

[45] Dec. 6, 1983

[54] HOLDING DEVICE

[76] Inventor: Robert A. Kallman, 2030 Haring St., Brooklyn, N.Y. 11229

[21] Appl. No.: 328,370

[22] Filed: Dec. 7, 1981

[51] Int. Cl.[3] ..... B65D 30/10

[52] U.S. Cl. ..... 383/11; 116/209; 206/5; 206/806; 224/42.46 R; 350/288; 383/7; 383/38; 383/86; 383/95; 383/103; 383/127; 383/110; 383/902; 383/907

[58] Field of Search ..... 150/2.1, 2.2, 2.5, 2.6, 150/1, 3, 7; 248/205.2

[56] References Cited

U.S. PATENT DOCUMENTS

| | | | |
|---|---|---|---|
| 2,528,192 | 10/1950 | Urban | 150/7 |
| 2,689,594 | 9/1954 | Wendt | 150/1 |
| 2,761,481 | 9/1956 | Boatwright | 150/1 |
| 3,321,068 | 5/1967 | Beach | 248/205.2 X |
| 4,153,089 | 5/1979 | Veilleux | 150/1 X |
| 4,196,817 | 4/1980 | Moser | 150/2.2 X |

FOREIGN PATENT DOCUMENTS

| | | | |
|---|---|---|---|
| 387473 | 5/1965 | Switzerland | 248/205.2 |

*Primary Examiner*—Donald F. Norton
*Attorney, Agent, or Firm*—Darby & Darby

[57] ABSTRACT

A multi-purpose holding device including a receptacle or pouch and a fastener particularly advantageous for use in moving vehicles. The surface of the pouch and one side of the fastener are constructed of complementary a hook and loop material which allows the pouch to be attached to and removed from the fastener. The other side of the fastener contains an adhesive for securing the fastener to an object base. The device is useful for holding many different objects. The holding device is also adapted to hold and insulate an open beverage container without spilling its contents. The pouch also preferably contains a second compartment and a slot between the surface of the pouch and a strip of light-reflecting material. As a result of the strip of light-reflecting material and the construction of the pouch and fastener the holding device is also adapted for use as a warning device.

9 Claims, 4 Drawing Figures

HOLDING DEVICE

BACKGROUND OF THE INVENTION

This invention relates to a multi-purpose holding device, including a receptacle adapted to be attachable to and detachable from a fastener which is mounted on a base object.

The receptacle of the present invention is particularly advantageous for use in moving automobiles and boats. Conventional holding devices for use in autos, boats, etc. are of several types. One familar type is a plastic holder which has a hook for hanging the holder to a part of an auto such as a partially opened side window or between the side window and door panel. The placement of such a holder is restricted to positions where the hook can fit. During movement of the vehicle such holders have not been found to be stable.

The holding device of the present invention includes a pouch, or receptacle, which is adapted to be attachable to and detachable from a fastener which is mounted on a base object. The surface of the pouch is formed of a material with loops which engage with hooks on one side of the fastener. The other side of the fastener has an adhesive for securing it to a base object. The holding device of the present invention can be mounted in a variety of positions on a number of different surfaces. The device is stable and the receptacle is detachable from the mounting fastener.

It is an object of the present invention to provide a multi-purpose receptacle which is readily accessible to the user.

Another object is to provide a multi-purpose receptacle constructed of a synthetic loop material which is easily attachable to a hook type fastener.

An additional object is to provide the receptacle with a compartment capable of holding a beverage container while preventing spilling of its contents and transferring of its temperature to the user's hand.

A further object is to provide the multi-purpose receptacle with a light reflecting material so as to make it useful as a warning device.

In the preferred embodiment, the pouch and the fastener are comprised of a a complementary synthetic material to form a statistical fastener. The surface of the pouch is formed of a material having loops. The front surface of the fastener is formed with protruding type hooks. The loops of the pouch engage with the hooks of the fastener. The pouch may be disengaged from the fastener by peeling the pouch from the fastener.

In addition, the receptacle may be lined with a thermally insulating material so that the receptacle is capable of holding and insulating a cold or hot container. Furthermore, a strip of material may be attached to the front section of the pouch to form additional compartments on the exterior of the pouch. This strip may be a light reflecting material which also allows the pouch to be used as a warning device.

BRIEF DESCRIPTION OF THE DRAWINGS

The following detailed description of the preferred forms of the invention will be best understood in conjunction with the accompanying drawings in which:

FIG. 4 is an elevational view of the closed receptacle, and.

DETAILED DESCRIPTION OF THE PREFERRED EMBODIMENT

Figure 1:
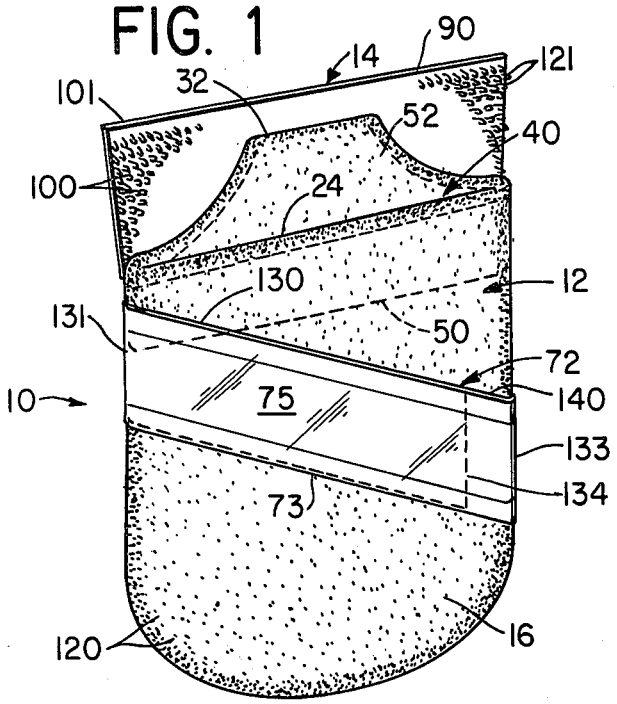
FIG. 1 is a perspective view of the receptacle.
Figure 2:
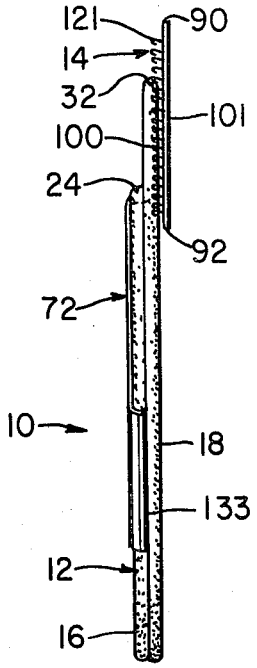
FIG. 2 is a side elevational view.
Figure 3:
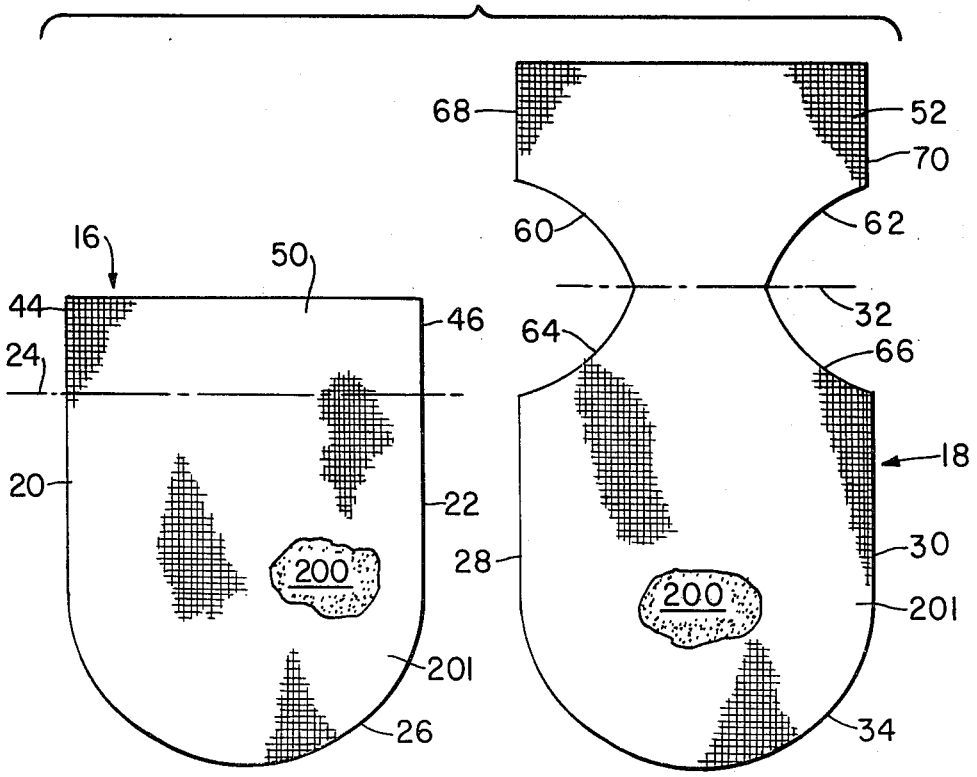
FIG. 3 is an elevational view of the front and rear panel blanks prior to assembly.

Referring to FIGS. 1, 2 and 3, a multi-purpose holding device 10 is illustrated as being formed in two parts, a receptacle, or pouch, 12 and a fastener 14.

Pouch 12 is preferably constructed from two panels of material 16 and 18 which are joined together at their respective edges to form a first compartment 40 therebetween. Pouch 12 may also be constructed from a single section of material folded upon itself and joined together to form the first compartment 40. Front panel 16 and rear panel 18 each have two vertical sides 20, 22 and 28, 30 respectively. Both panels, 16 and 18, also have, respectively, top edges 24 and 32, as defined by dot-dash lines in FIG. 3, and rounded bottom edges 26 and 34 respectively. It is also possible to construct the bottom edges 26 and 34 with other shapes. The width of the front panel 16 is preferably equal to the width of the rear panel 18. Sides 20 and 28, 22 and 30 and bottom edges 26 and 34 are joined together, as by sewing or adhesive, to form pouch 12 and the first compartment 40.

Referring to FIG. 3, the inside front and rear walls 50 and 52 of compartment 40 are extentions of the front and rear panels 16 and 18 of pouch 12 respectively. The front wall 50 is formed by folding about the top edge 24 of front panel 16 inwardly with respect to compartment 40, upon itself such that vertical sides 44 and 46 extend downwardly within compartment 40. This folded top edge 32 allows objects such as eyeglasses to be inserted into compartment 40 and then completely enclosed under folded extension 52. Rear panel 18 contains an integral upper wall or extension 52. This extension 52 extends above the folded, horizontal top edge 32 of the rear panel 18. The extension 52 is formed by folding about the top edge 32 of rear panel 18. The folded extension 52 extends vertically downward below the bottom edge of the inner front wall 50 and into compartment 40 along sides 68 and 70. Extention 52 is attached, as by sewing, along its edges 60 and 62 to the corresponding edges 64 and 66 respectively of rear panel 18 and vertically downward along sides 68 and 70 to the vertical sides 44 and 46 respectively of front wall 50. Extension 52 provides a partial lining for the rear panel 18 of compartment 40. The resulting partially lined receptacle 12 and fastener 14 are substantially flat in cross section, as shown in FIG. 2, in order to minimize the area it occupies.

The fastener 14 has a front 100 and a back 101. The back is coated with a pressure sensitive adhesive, preferably a vinyl adhesive containing plasticizers. This adhesive coating allows the fastener 14 to be firmly secured to external surfaces. The fastener 14 can also be formed with ventilation holes (not shown) which extend through the back 101 of fastener 14. The ventilation holes assist in preventing plasticizer buildup in the adhesive which tends to lead to disintegration of the adhesive.

Fastener 14 is preferably formed in the shape of a trapezoid, however, other shapes can be employed. The trapezoidal fastener 14 has a top edge 90 and a narrower bottom edge 92. It is preferred that the length of bottom edge 92 be wider than top edge 32 of rear section 18 of pouch 12 and approximately as wide as the entire width of rear section 18 itself. It is also preferred that the length of the fastener 14, between edges 90 and 92, be longer than the distance between top edge 24 of front section 16 and top edge 32 of rear section 18 of pouch 12.

The pouch 12 is formed of a nubby material having a plurality of minute loops 120. This material is preferably a Trico® backed Vel-foam® material. The surface of the front 100 of fastener 14 is formed with a plurality of small hooks 121. These hooks 121 are preferably arranged in a matrix of rows and columns. The hooks extend perpendicularly outward from the front 100 and engage the loops of the pouch 12 upon application of pressure to form what is called a statistical fastener. It is also possible to construct part of the pouch 12 with hooks 121 and the front 100 of fastener 14 with loops 120 thereon.

Figure 4:
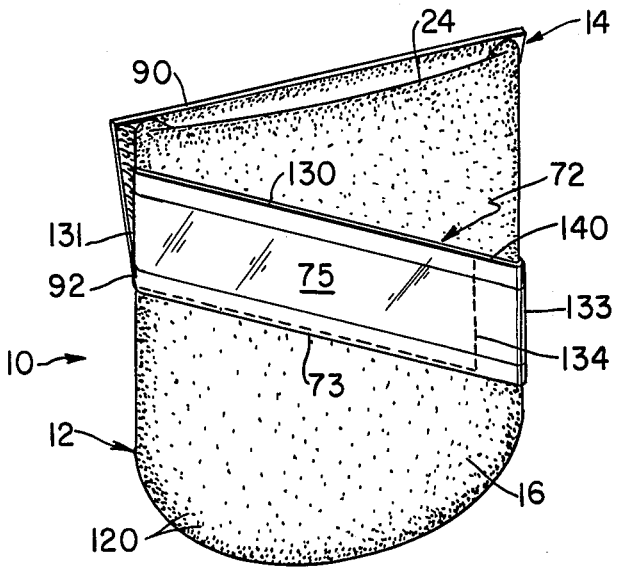

As a result of the interaction or entanglement of the hook and loop elements, the first compartment 40 formed in receptacle 12 may be sealed. The sealing of the compartment 40 may be accomplished in two ways. First, the top edge 32 of rear panel 18 can be folded over top edge 24 of front panel 16. After folding top edge 32 over top edge 24 the user can rotate the pouch 12 one hundred and eighty degrees from that shown in FIG. 1 so that the front panel 16 and the top edge 32 of rear panel 18 face the loops 120 on the front side 100 of fastener 14. By pressing the loops 120 of pouch 12 against the hooks 121 of fastener 14 the first compartment 40 may be sealed. The pouch may also be sealed by folding top edge 32 upon itself and placing it within first compartment 40 as shown in FIG. 4. Both the loops 120 of the top of the front panel 16 along top edge 24 and the loops of the top edge 32 of folded rear panel 18, may then be pressed against the hooks 121 of fastener 14 to seal compartment 40.

The loop material used for pouch 12 is preferably soft and non-abrasive. As a result, fragile items such as sunglasses can be safely and securely encased within compartment 40. The only restrictions determining the size of the objects which can be stored in first compartment 40 are the length of the front panel 16, between the top edge 24 and the bottom edges 26 and 34, and the width of front panel 16. The weight of the objects which can be encased in first compartment 40 is determined by the holding power of the interaction of fastener 14 and pouch 12. When heavy objects are desired to be encased within first compartment 40, the user may attach pouch 12 to fastener 14 at a point sufficiently above top edge 24 of frot panel 16. This assists in maintaining pouch 12 securely attached to fastener 14.

The pouch 12 may be used to hold objects with first compartment 40 open by securing rear panel 18 to fastener 14 as shown in FIGS. 1 and 2.

The pouch may be attached to the fastener at any angle relative to its vertical center. This facilitates the ease of insertion and removal of most items by tilting the top of the pouch downward, thereby allowing objects in compartment 40 to move by gravity into the user's hand. The bottom edges 26 and 34 are preferably rounded as opposed to being square or angularly cornered so that small round objects such as coins are easily released from compartment 40 when the receptacle is tilted. The angular positioning of the pouch relative to its vertical center of the fastener is advantageous when considering the physiology of the human anatomy when the fastener is secured at a position to the side of the user, such as on car door panels.

Figure 5:
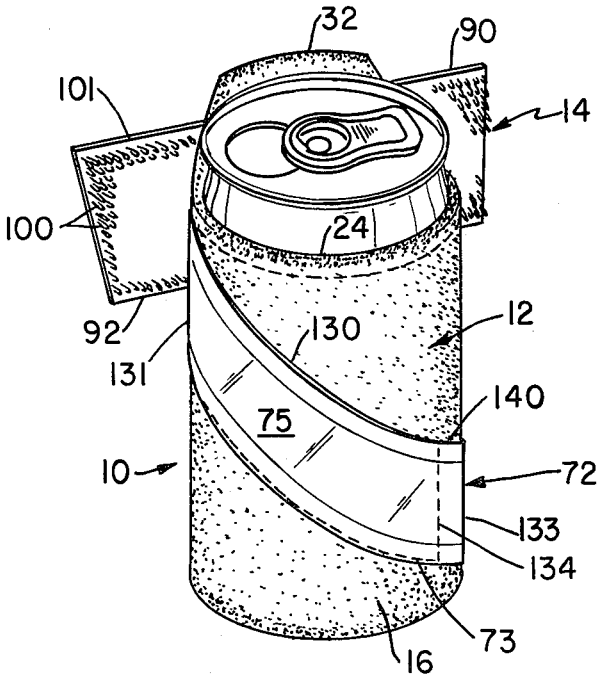
FIG. 5 is a front elevational view of the device shown holding a beverage container with its drinking opening set for use as on a driver's (left) door.

The holding device of the present invention may be specifically adapted to hold a beverage container, such as a 12 oz. soda can, in compartment 40, as shown in FIG. 5, by designing the size of the pouch 12 so that the volume of compartment 40 is substantially the same as the size of the beverage container. The soda can or container is held fast in both the vertical and horizontal planes by securing rear panel 18 of pouch 12 to the fastener 14 at points both directly above and below top edge 24 of front panel 16. The connection of the pouch 12 and fastener 14 above top edge 24 is significantly above the moment of rotation of the can and prevents its horizontal rotation or swaying in the pouch. The connection of the pouch 12 and fastener 14 below the top edge 24 of front panel 16 is significantly below the cantilevering moment of the can and minimizes the vertical movement of the can. As a result, the holding device minimizes both horizontal and vertical movement of the can. The need to prevent horizontal swaying or swiveling is especially desirable when using the holding device to encase an open beverage container in a moving vehicle without spilling its contents. The pouch and its contents are easily removed from fastener 14 by peeling the pouch from the fastener by rotating the pouch in the horizontal direction relative to the fastener.

The bottom edges of holding device are well suited for this application. The bottom edges 26 and 34 of the front and rear sections are preferably rounded to hold a standard size, 12 oz., soda can in a position in the first compartment 40 such that the lip and the top one half to three quarters inches of the can be exposed. This prevents the receptacle from coming into contact with the drinkers lips.

In addition, extension 52 has a tapered construction to avoid facial skin contact with the pouch when the can and pouch are removed from the fastener for drinking. Edges 60, 62, 64, and 66 of extension 52 are arcurately tapered between the top edge 24 of the front panel 16 and the top edge 32 of the rear panel 18. When the container is placed in the first compartment 40 with its drinking opening positioned parallel to the top edges 24 and 32, the pouch may be removed from fastener 14 and placed into drinking position without requiring additional can or pouch rotation which is important when driving a vehicle. Tapered edges 60, 62, 64, and 66 also prevent the drinker's face from coming into contact with the pouch material.

Additionally, the entire surface of the first compartment 40 may be lined with a thermally insulating material 200. This material, preferably a foam, maintains the temperature of the enclosed can and prevents the transfer of the temperature of the enclosed can to the user's hand. This insulating liner is preferably comprised of two parts. The liner 200 is attached to front panel 16 and rear panel 18 before the panels are joined together. The first part is attached to the inside of front panel 16 and wall 50. The second part is attached to the inside of rear panel 18 and extension 52. In order to allow easy insertion of the container into the first compartment 40, the insulating liner 200 is preferably provided with a material having a smooth surface 201. The liner 200 is preferably a material, such as Trico®.

Furthermore, pouch 12 may be provided with additional external compartments 130 and 140. Pouch 12 may also be adapted to alternately serve as a warning device as shown in FIG. 1. A strip of material 72 is attached, as by sewing or adhesive, diagonally across front panel 16. Strip 72 may alternately be attached horizontally across rear panel 18 in addition to, or instead of, across front panel 16. Strip 72 is preferably secured along its sides 131 and 133 to vertical sides 20 and 22 of front panel 16 respectively. In the preferred form of the invention, strip 72 is placed at an angle diagonally across front panel 16, close to top edge 24 of front panel 16, along vertical side 20 and bottom edge 26, and along vertical side 22. The bottom edge 73 of strip 72 is partially attached, as by sewing or adhesive, to front panel 16. At a vertical line 134 intermediate sides 131 and 133, and preferably closer to side 133, the strip is attached to front panel 16 thereby forming second compartment 130 and third compartment or slot 140. The second compartment 130 is formed between vertical line 134 and vertical side 131 and between the bottom edge 73 of strip 72 and front panel 16. Slot 140 is formed, without a bottom, between vertical line 134 and vertical side 133 and between strip 72 and front panel 16. The second compartment 130 is suitable for holding such objects as cigarette lighters, change and matchbooks. Compartment 130 may also be subdivided into smaller compartments, for example, by attaching the strip 72 to front section 16, as by sewing or adhesive, at other points along the length of the strip 72.

Slot 140 is useful for holding writing instruments such as pens with clips. In addition, this slot 140 can be used for insertion about an automobile antenna when the receptacle is used as a warning device as described below.

In the preferred form of the invention, strip 72 contains a reflecting surface 75. This reflecting surface 75 is useful for alerting oncoming vehicles at increased distances in dark areas by placing the pouch 12 on the user's hand or on the interior door panel, hood or trunk by fastener 14, or by placing the pouch 12 over the auto antennae as through slot 140. The reflecting material will reflect the oncoming vehicles headlights back to the driver. When receptacle 12 is used as a warning device, it is also preferable to construct pouch 12 with a bright color such as yellow or red, which is easily visible from a distance.

What is claimed is:

1. A device for holding objects, said device being substantially flat when empty of said objects, comprising:

a receptacle having flexible front and rear panels, said front and rear panels being secured to each other along the respective sides and bottoms to form a first compartment;

said rear panel having an extension piece extending above said first compartment;

a fastener having first means on one side thereof for attachment to a base object and second means on a second side thereof for securing said receptacle to said fastener, said extension piece and said second means of said fastener being comprised of complementary materials which are secured together when pressed; and wherein said receptacle's front and rear panel bottoms are rounded for encasing a cylindrical object, whereby said compartment substantially conforms to a cylindrical object inserted therein.

2. A beverage holder for holding cylindrical beverage containers, said holder being substantially flat when empty, comprising:

a receptacle having flexible front and rear panels, said front and rear panels being secured to each other along their respective sides and bottoms to form a first compartment, said receptacle's front and rear panel bottoms being rounded for encasing a cylindrical object, whereby said compartment substantially conforms to a cylindrical object inserted therein;

said front panel length being selected to permit an upper portion of a beverage container fully inserted into said compartment to protrude from said compartment to avoid contact with a user's lips when drinking from said beverage container;

said rear panel having an extension piece extending above said compartment, the edges of said extension piece being tapered to avoid contact with said user's face when said holder is raised to said user's face for drinking from said beverage container inserted therein; and a fastener having first means on one side thereof for attachment to a base object and a second means on a second side thereof for securing said receptacle to said fastener, said extension piece and said second means of said fastener being comprised of complementary materials which are secured together when pressed.

3. The holding device according to claim 1 or 2 wherein said receptacle panels and said second means of said fastener comprise a statistical fastener of loop and hook material respectively.

4. The receptacle according to claim 1 or 2 further comprising a strip of material secured along its sides to the sides of the front panel, along a portion of its lower edge to the front panel and vertically down the front panel intermediate the side edges of the front panel to form a second compartment between one side of the front panel and the vertical connection between the strip and the front panel and a slot between the other side of the vertical connection and the front panel.

5. The receptacle according to claim 4 wherein the strip is a light reflecting material and the receptacle is useful as a warning device.

6. The container according to claim 1 or 2 wherein the top portion of said rear panel is foldable over or under the top of the front panel to close said first compartment.

7. The receptacle according to claim 1 or 2 wherein at least one of said panels and said second means of said fastener are comprised of complementary materials which secure together when pressed.

8. The holding device according to claim 2 wherein a portion of the edges of the rear wall of said rear panel are arcuately tapered.

9. The beverage holder according to claim 2 further comprising a thermally-insulating material lining the inner surfaces of said panels.

* * * * *